US009141124B1

(12) United States Patent
Nien

(10) Patent No.: US 9,141,124 B1
(45) Date of Patent: Sep. 22, 2015

(54) BANDGAP REFERENCE CIRCUIT

(71) Applicant: Elite Semiconductor Memory Technology Inc., Hsinchu (TW)

(72) Inventor: Shu-Han Nien, Changhua County (TW)

(73) Assignee: Elite Semiconductor Memory Technology Inc., Hsinchu (TW)

( * ) Notice: Subject to any disclaimer, the term of this patent is extended or adjusted under 35 U.S.C. 154(b) by 0 days.

(21) Appl. No.: 14/315,194

(22) Filed: Jun. 25, 2014

(51) Int. Cl.
*G05F 3/16* (2006.01)
*G05F 3/20* (2006.01)
*G05F 3/22* (2006.01)

(52) U.S. Cl.
CPC ..... *G05F 3/22* (2013.01)

(58) Field of Classification Search
USPC ..... 323/311–316
See application file for complete search history.

(56) References Cited

U.S. PATENT DOCUMENTS

| | | | | |
|---|---|---|---|---|
| 6,052,020 | A * | 4/2000 | Doyle | 327/539 |
| 6,329,804 | B1 * | 12/2001 | Mercer | 323/315 |
| 6,933,770 | B1 * | 8/2005 | Ranucci | 327/539 |
| 7,372,243 | B2 * | 5/2008 | Kimura | 323/313 |
| 7,446,598 | B2 * | 11/2008 | Pertijs et al. | 327/539 |
| 7,570,107 | B2 * | 8/2009 | Kim et al. | 327/539 |
| 7,961,041 | B2 * | 6/2011 | Motz | 330/9 |
| 8,531,235 | B1 * | 9/2013 | Zonte | 327/512 |
| 2009/0302822 | A1 * | 12/2009 | Chao et al. | 323/313 |

* cited by examiner

*Primary Examiner* — Adolf Berhane
*Assistant Examiner* — Gary Nash
(74) *Attorney, Agent, or Firm* — Juan Carlos A. Marquez; Bacon & Thomas PLLC

(57) ABSTRACT

A bandgap reference circuit incorporates first, second, and third current sources, an operational amplifier coupled to the second and the third current sources, a voltage divider, a first resistor, and first, second, and third bipolar transistors. The second bipolar transistor has a base configured to receive a first voltage from the voltage divider. The third bipolar transistor has a base configured to receive a second voltage from the voltage divider. The first resistor is coupled between the third current source and the third bipolar transistor.

7 Claims, 4 Drawing Sheets

BANDGAP REFERENCE CIRCUIT

BACKGROUND OF THE INVENTION

1. Field of the Invention

The present invention relates generally to reference circuits, and more specifically to a bandgap reference circuit.

2. Description of the Related Art

A bandgap reference circuit is used to generate a precise output voltage. The generated voltage is independent of process, voltage, and temperature. The band-gap reference circuit is widely used in various analogue and digital circuits that require a precise voltage for operation.

FIG. 1 illustrates one commonly used bandgap reference circuit 100.

Referring to FIG. 1, the bandgap reference circuit 100 includes PMOS transistors M1, M2, and M3, an operational amplifier OP, resistors R1 and R2, and bipolar transistors Q1, Q2, and Q3. If the base current is neglected, the output voltage VOUT of the bandgap reference circuit 100 can be expressed as:

$$VOUT=VEB3+VT\times\ln N\times R2/R1 \quad (1)$$

Where VEB3 is the emitter-base voltage of the bipolar transistor Q3, VT is the thermal voltage at room temperature, and N is the ratio of the current density of the transistor Q2 to the current density of the transistor Q1.

As can be seen from the equation (1), by adjusting the ratio of resistors R2/R1, the conventional bandgap reference circuit 100 can provide a stable reference voltage VOUT having a zero temperature coefficient. The voltage level of the voltage VOUT is at around 1.25V, which is approximately equal to the silicon energy gap measured in electron volts, i.e., the silicon bandgap voltage.

SUMMARY OF THE INVENTION

An aspect of the present invention is to provide a bandgap reference circuit.

According to one embodiment of the present invention, the bandgap reference circuit comprises first, second, and third current sources, an operational amplifier coupled to the first, second and the third current sources, a voltage divider, a first resistor, and first, second, and third bipolar transistors. The first bipolar transistor has an emitter coupled to the first current source, a base and a collector coupled to a ground voltage. The voltage divider is coupled between the emitter and the base of the first bipolar transistor, wherein the voltage divider provides first and second voltages proportional to a base-emitter voltage of the first bipolar transistor. The second bipolar transistor has a base configured to receive the first voltage, an emitter coupled to the second current source, and a collector coupled to the ground voltage. The third bipolar transistor has a base configured to receive the second voltage, and a collector coupled to the ground voltage. The first resistor is coupled between the third current source and an emitter of the third bipolar transistor. The first, second, and third current sources are configured to provide currents proportional to absolute temperature (PTAT) currents.

BRIEF DESCRIPTION OF THE DRAWINGS

The invention will be described according to the appended drawings in which.

DETAILED DESCRIPTION OF THE INVENTION

Figure 2:
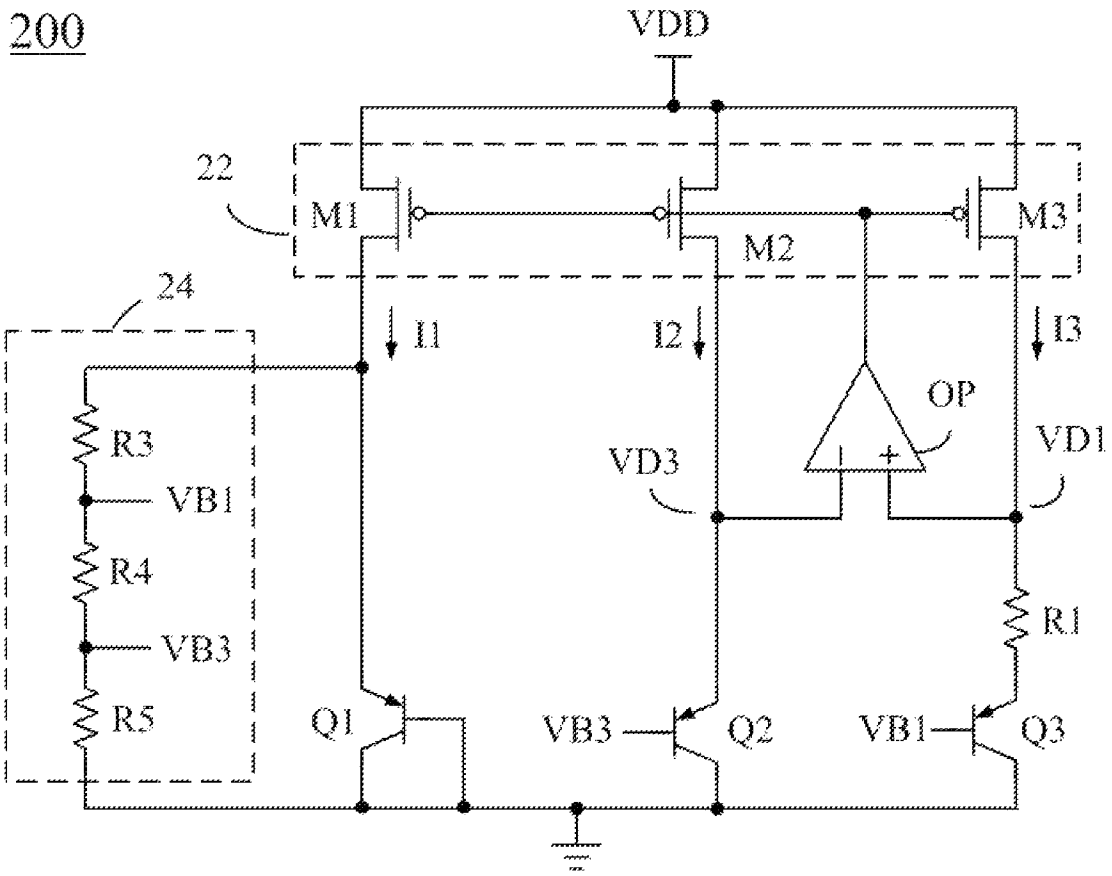
FIG. 2 shows a schematic diagram of a bandgap reference circuit according to one embodiment of the present invention.

FIG. 2 shows a schematic diagram of a bandgap reference circuit 200 according to one embodiment of the present invention. Referring to FIG. 2, the bandgap reference circuit 200 comprises a current source unit 22, a voltage divider 24, an operational amplifier OP, a resistor R1, and three bipolar transistors Q1, Q2, and Q3. In this embodiment, the current source unit 22 is constructed from three PMOS transistors M1, M2, and M3. These PMOS transistors M1, M2, and M3 are electrically connected to a supply voltage VDD such that currents, labeled I1, 12, and 13, are produced. Since the gates of the PMOS transistors M1, M2, and M3 are connected to each other, the currents flowing through the PMOS transistors M1, M2, and M3 depend on the W/L ratio of the transistors.

In this embodiment, a size ratio of the PMOS transistors M1, M2, and M3 in the current source unit 22 is set to 2:1:1. Therefore, the current I2 is substantially equal to the current I3, and the current I1 has twice the magnitude of the current I2.

Referring to FIG. 2, the bipolar transistor Q1 has an emitter coupled to a drain of the PMOS transistor M1, and a base and a collector both coupled to a ground voltage. The bipolar transistor Q2 has an emitter coupled to a drain of the PMOS transistor M2, a base coupled to a voltage VB3 from the voltage divider 24, and a collector coupled to the ground voltage. The bipolar transistor Q3 has a base coupled to a voltage VB1 from the voltage divider 24 and a collector coupled to the ground voltage. The resistor R1 is couple between a drain of the PMOS transistor M3 and an emitter of the bipolar transistor Q3.

Referring to FIG. 2, the operational amplifier OP has a positive input terminal coupled to the drain of the PMOS transistor M3, a negative input terminal coupled to the drain of the PMOS transistor M2, and an output terminal coupled to the gates of the PMOS transistors M1, M2, and M3. The amplifier OP and the PMOS transistors M2 and M3 constitute a negative feedback loop which forces the voltages VD1 and VD3 to be substantially equal. Thus, the voltages VD1 and VD3 can be expresses as:

$$VD1=VD3=VB3+VEB2=VB1+VEB3+I3\times R1 \quad (2)$$

Where VEB2 is the emitter-base voltage of the bipolar transistor Q2, and VEB3 is the emitter-base voltage of the bipolar transistor Q3.

Referring to FIG. 2, the voltage divider 24 is coupled to the emitter of the bipolar transistor Q1. In this embodiment, the voltage divider 24 is formed by three series connected resistors R3, R4, and R5. Therefore, the voltage divider 24 provides the voltages VB1 and VB3 proportional to a base-emitter voltage of the bipolar transistor Q1. Thus, the voltages VB1 and VB3 can be expressed as:

$$VB3=VEB1\times R5/(R3+R4+R5) \quad (3)$$

$$VB1=VEB1\times(R4+R5)/(R3+R4+R5) \quad (4)$$

Where VEB1 is the emitter-base voltage of the bipolar transistor Q1.

Accordingly, equation (2) can be re-arranged as:

$$I3\times R1=VEB2-VEB3+VB3-VB1=VT\times\ln N-VEB1\times R4/(R3+R4+R5) \quad (5))$$

Where VT is the thermal voltage at room temperature, and N is the ratio of the current density of the transistor Q2 to the current density of the transistor Q1. In this embodiment, the currents flowing through the transistors Q1, Q2, and Q3 are substantially equivalent Thus, the current I3 through the resistor R1 can be expressed as:

$$I3=VT\times\ln N/R1-VEB1\times R4/(R1\times(R3+R4+R5)) \quad (6)$$

Since the thermal voltage VT has a positive temperature coefficient of 0.085 mV/° C. and the emitter-base voltage of the transistor Q1 has a negative temperature coefficient of −2 mV/° C., the current I3 has a temperature dependency slope. Due to the factor −VEB1×(R4/(R3+R4+R5)), the temperature dependency slope of the current I3 increases faster with temperature increase when it is compared with the prior art.

Figure 3:
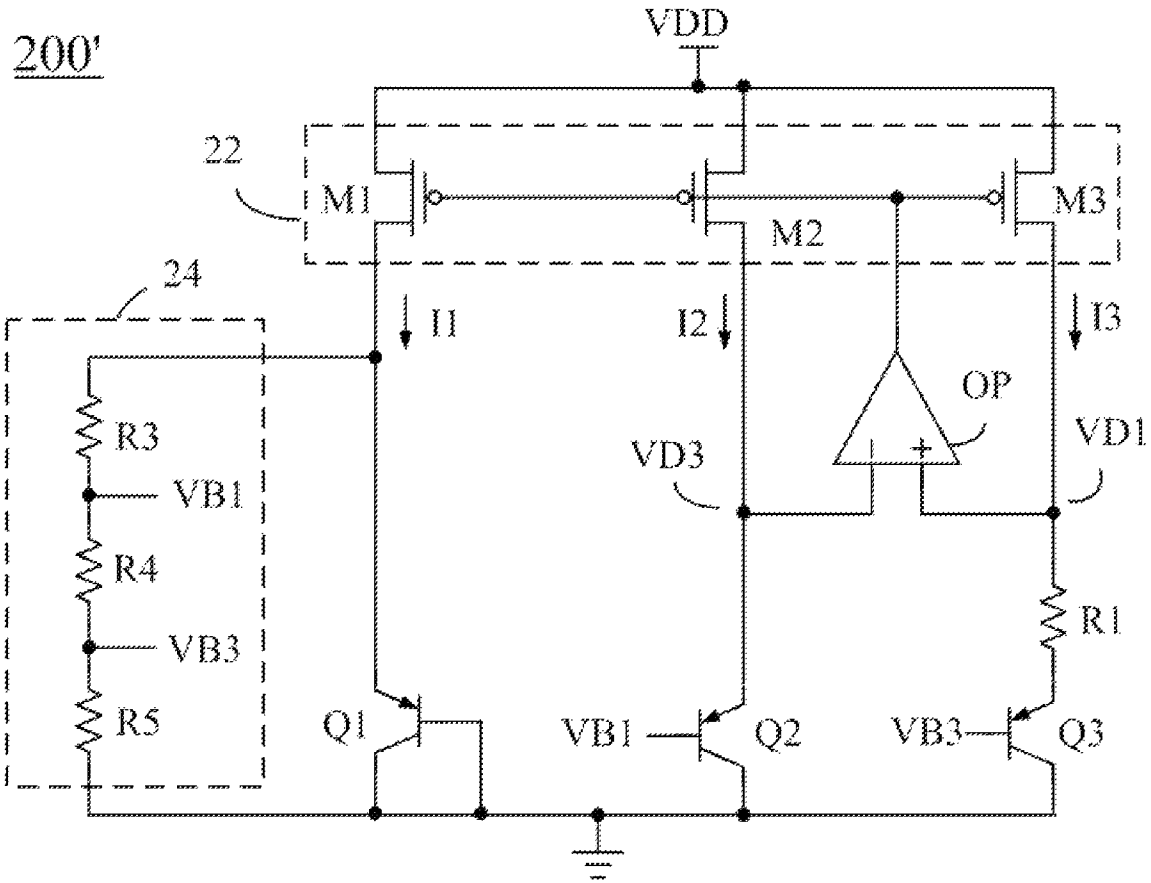
FIG. 3 shows a schematic diagram of a bandgap reference circuit according to another embodiment of the present invention.

As can be seen from equation (6), the net temperature coefficient of the current I3 can be varied by choosing resistance values of the resistors R1, R3, R4, and R5, and the ratio of the current density of the transistor Q2 to the current density of the transistor Q1. In addition, the base of the transistor Q2 can be coupled to the voltage VB1 from the voltage divider 24, and the base of the transistor Q3 can be coupled to the voltage VB3 from the voltage divider 24 as shown in FIG. 3, such that the net temperature coefficient of the current I3 is reduced compared with the circuit configuration of FIG. 2.

Figure 4:
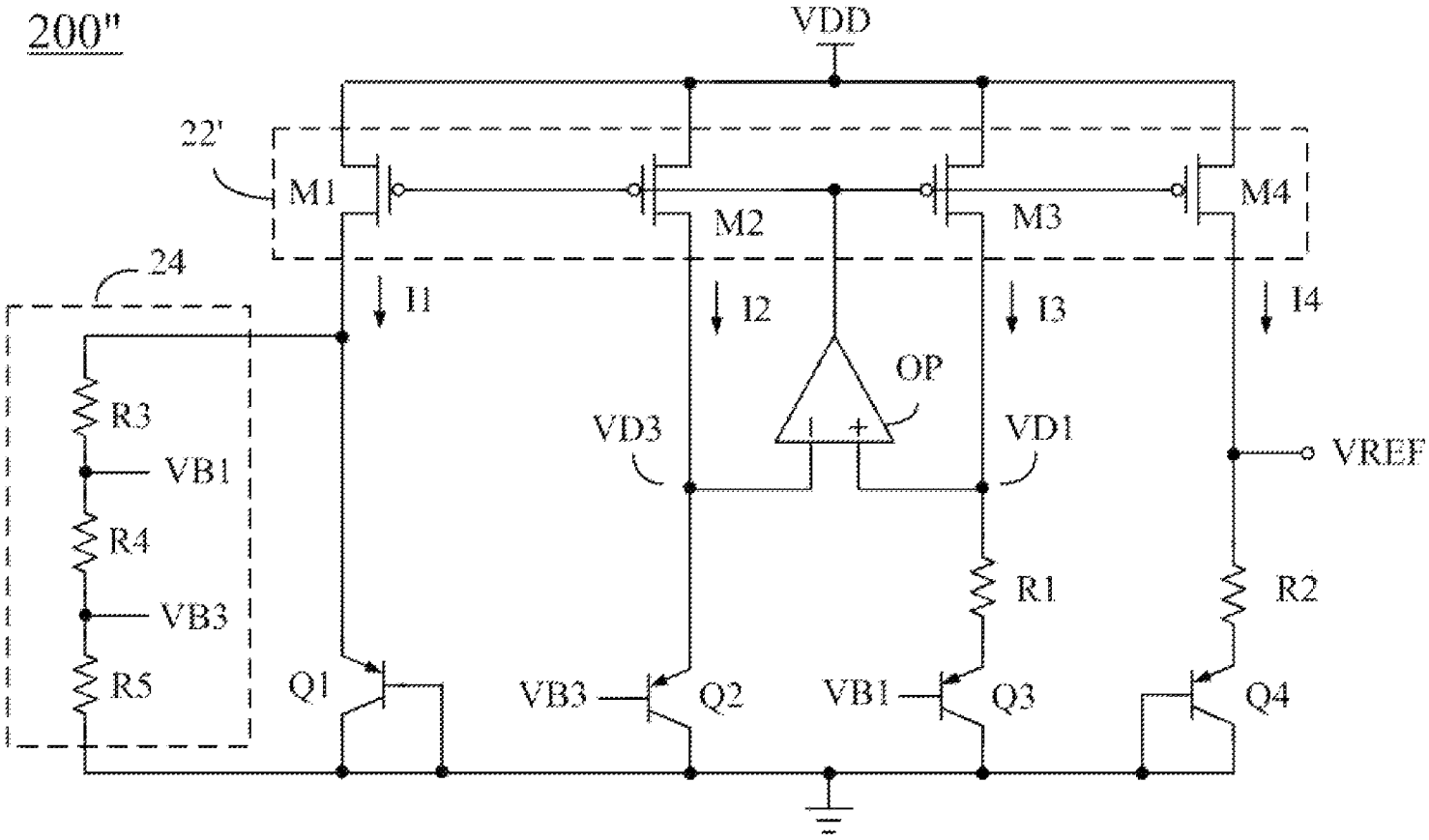
FIG. 4 shows a schematic diagram of a bandgap reference circuit according to yet another embodiment of the present invention.

In order to provide a stable output reference voltage with a zero temperature coefficient, the bandgap reference circuit 200" further comprises a resistor R2 and a bipolar transistor Q4 as shown in FIG. 4. Referring now to FIG. 4, the current source unit 22' is constructed from the PMOS transistors M1, M2, M3, and M4 with gates driven by the output of the amplifier OP. In this embodiment, the PMOS transistor M4 and the PMOS transistor M3 have substantially equal sizes. Therefore, the current I4 flowing through the resistor R2 is the same as the current I3, and can be expressed as:

$$I4=I3=VT\times\ln N/R1-VEB1\times R4/(R1\times(R3+R4+R5)) \quad (7)$$

With such circuit configuration, the voltage VREF can be expressed as:

$$VREF=VEB4+I4\times R2 \quad (8)$$

Where VEB4 is the emitter-base voltage of the bipolar transistor Q4.

Substituting equation (7) into equation (8) gives:

$$VREF=VEB4+VT\times\ln N\times R2/R1-VEB1\times R2\times R4/(R1\times(R3+R4+R6)) \quad (9)$$

Hence, if proper resistance values of the resistors R1, R2, R3, R4, and R5 are selected, the output voltage VREF of the bandgap reference circuit 200" will have a zero temperature coefficient and low sensitivity to temperature.

In addition, compared with the prior art, the bandgap reference circuit 200" of FIG. 4 can be operable at a lower supply voltage level. Recalling equation (1):

$$VOUT=VEB3+VT\times\ln N\times R2/R1 \quad (1)$$

From equation (1) it can be seen that the output voltage of the conventional bandgap reference circuit is limited to 1.25V in order to obtain a zero temperature coefficient. However, from equation (9) it can be seen that the output voltage VOUT of the bandgap reference circuit of the invention can reduce by a voltage proportional to a base-emitter voltage of the first bipolar transistor Q1. In an exemplary embodiment, if the ratio N is selected to be 32, the resistance values of the resistors R1, R2, R3, R4, and R5 are respectively selected to be 39KΩ, 225KΩ, 114KΩ, 4KΩ, and 84KΩ, the bandgap reference circuit of the invention can provide a lower output voltage VREF at around 1.11V. Thus, the operating supply voltage can be less than 1.35V by using this circuit.

In addition, the bandgap reference circuit of the invention can effectively reduce the DC offset due to the input offset of the operational amplifier. When considering the input offset VOS of the operational amplifier OP of FIG. 1, the equation (1) can be rewritten as:

$$VOUT=VEB3+VT\times\ln N\times R2/R1+VOS\times R2/R1 \quad (10)$$

Figure 1:
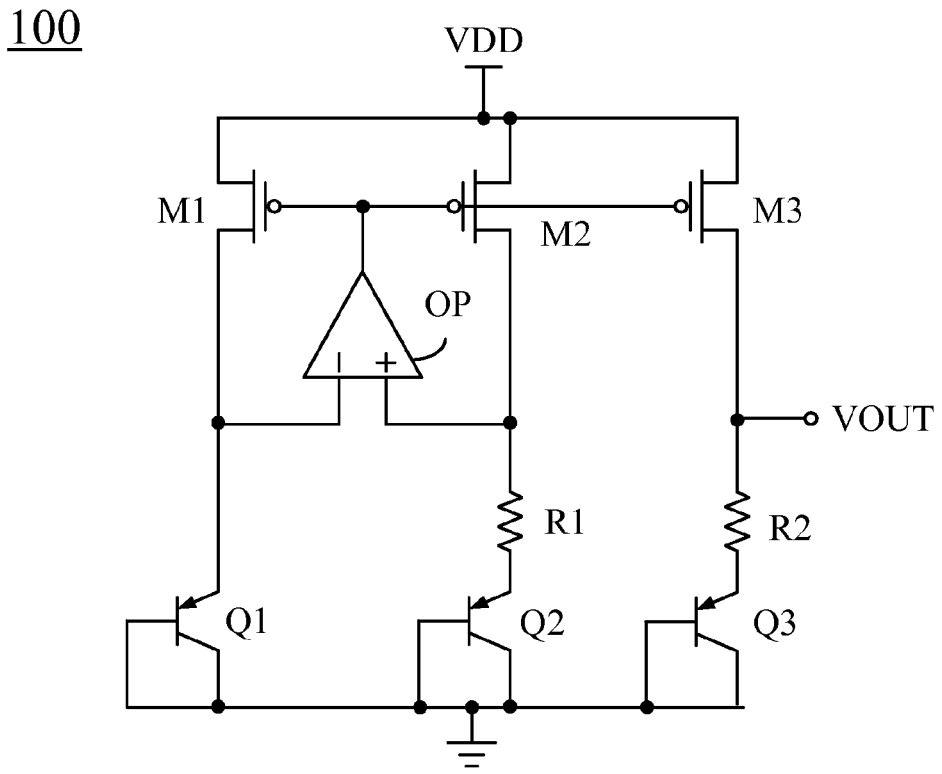
FIG. 1 (Prior Art)
FIG. 1 illustrates one commonly used bandgap reference circuit.

Thus, the input offset VOS of the operational amplifier OP of FIG. 1 is amplified by the ratio of the resistance of the resistor R2 to the resistance of the resistor R1. When considering the input offset VOS of the operational amplifier OP of FIG. 2 of the invention, the equation (9) is rewritten as:

$$VREF=VEB4+VT\times\ln N\times R2/R1-VEB1\times R2\times R4/(R1\times(R3+R4+R5))+VOS\times R2/R1 \quad (11)$$

Since the factor of −VEB1×R2×R4/(R1×(R3+R4+R5)) is added to effect the temperature coefficient of the output voltage VREF, the ratio of the resistance of the resistor R2 to the resistance of the resistor R1 can be reduced in order to obtain the voltage VREF with a zero temperature coefficient. Therefore, the amplification factor of the input offset of the operational amplifier can be reduced by using the bandgap reference circuit of the invention.

The above-described embodiments of the present invention are intended to be illustrative only. Numerous alternative embodiments may be devised by those skilled in the art without departing from the spirit and scope of the invention as recited in the following claims.

What is claimed is:

1. A bandgap reference circuit, comprising:

first, second, and third current sources;

an operational amplifier coupled to the first, second and the third current sources;

a first bipolar transistor having a base, an emitter, and a collector, the emitter coupled to the first current source, the base and the collector coupled to a ground voltage;

a voltage divider coupled between the emitter and the base of the first bipolar transistor, wherein the voltage divider provides first and second voltages proportional to a base-emitter voltage of the first bipolar transistor;

a second bipolar transistor having a base, an emitter, and a collector, the base configured to receive the first voltage, the emitter coupled to the second current source, and the collector coupled to the ground voltage;

a third bipolar transistor having a base, an emitter, and a collector, the base configured to receive the second voltage, and the collector coupled to the ground voltage; and a first resistor coupled between the third current source and the emitter of the third bipolar transistor.

2. The bandgap reference circuit of claim 1, further comprising:

a fourth current source, coupled to the operational amplifier;

a fourth bipolar transistor having a base, an emitter, and a collector, the base and the collector coupled to the ground voltage; and a second resistor coupled between the fourth current source and the emitter of the fourth bipolar transistor;

wherein an intersection of the fourth current source and the second resistor provides a bandgap reference voltage.

3. The bandgap reference circuit of claim 2, wherein the voltage divider comprises:

a plurality of resistors serially connected between the emitter and the base of the first bipolar transistor for providing the first and second voltages;

wherein a voltage level of the first voltage is less than a voltage level of the second voltage; and wherein resistance values of the resistors of the voltage divider and resistance values of the first and the second resistors are selected such that the bandgap reference voltage is less than a silicon bandgap voltage.

4. The bandgap reference circuit of claim 1, wherein the voltage divider comprises:

a plurality of resistors serially connected between the emitter and the base of the first bipolar transistor for providing the first and second voltages;

wherein a voltage level of the first voltage is greater than a voltage level of the second voltage.

5. The bandgap reference circuit of claim 4, wherein resistance values of the resistors of the voltage divider and a resistance value of the first resistor are selected to vary the temperature coefficient of the currents of the first, second, and third current sources.

6. The bandgap reference circuit of claim 1, wherein the voltage divider comprises:

a plurality of resistors serially connected between the emitter and the base of the first bipolar transistor for providing the first and second voltages;

wherein a voltage level of the first voltage is greater than a voltage level of the second voltage.

7. The bandgap reference circuit of claim 6, wherein resistance values of the resistors of the voltage divider and a resistance value of the first resistor are selected to vary the temperature coefficient of the currents of the first, second, and third current sources.

* * * * *